US008506337B2

(12) United States Patent
Gallato et al.

(10) Patent No.: US 8,506,337 B2
(45) Date of Patent: Aug. 13, 2013

(54) CONTROL DEVICE AND BOAT DRIVE COMPRISING A CONTROL DEVICE

(75) Inventors: Fernando Gallato, Padua (IT); Adone Bertolo, Padua (IT); Daniele Sacchi, Padua (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 193 days.

(21) Appl. No.: 13/140,036

(22) PCT Filed: Feb. 11, 2010

(86) PCT No.: PCT/EP2010/051698
§ 371 (c)(1),
(2), (4) Date: Jun. 16, 2011

(87) PCT Pub. No.: WO2010/094612
PCT Pub. Date: Aug. 26, 2010

(65) Prior Publication Data

US 2011/0294377 A1 Dec. 1, 2011

(30) Foreign Application Priority Data

Feb. 18, 2009 (DE) ..... 10 2009 000 993

(51) Int. Cl.
*B63H 21/21* (2006.01)

(52) U.S. Cl.
USPC ..... 440/86; 114/144 RE

(58) Field of Classification Search
USPC ..... 440/58, 86; 114/144 R, 144 RE; 74/640, 473.12; 475/5, 7, 150
See application file for complete search history.

(56) References Cited

U.S. PATENT DOCUMENTS

| | | | | |
|---|---|---|---|---|
| 3,013,519 | A | 12/1961 | Wiggermann | |
| 3,548,775 | A * | 12/1970 | Horn et al. | 114/144 B |
| 4,614,900 | A * | 9/1986 | Young | 114/144 R |
| 4,746,311 | A * | 5/1988 | Kraus | 440/6 |
| 6,431,928 | B1 | 8/2002 | Aarnivuo | |
| 6,546,889 | B1 | 4/2003 | Jacob et al. | |
| 6,688,927 | B2 * | 2/2004 | Aarnivuo | 440/58 |
| 7,186,157 | B2 | 3/2007 | Mansson et al. | |
| 2005/0215131 | A1 | 9/2005 | Oguma et al. | |
| 2006/0073934 | A1 | 4/2006 | Kasahara | |

FOREIGN PATENT DOCUMENTS

| | | | |
|---|---|---|---|
| DE | 1 012 843 | B | 7/1957 |
| DE | 197 23 358 | A1 | 12/1998 |
| DE | 601 00 655 | T2 | 7/2004 |
| DE | 699 22 397 | T2 | 12/2005 |
| JP | 2007-008189 | A | 1/2007 |
| WO | 2004/108523 | A1 | 12/2004 |
| WO | 2005/005249 | A1 | 1/2005 |

* cited by examiner

*Primary Examiner* — Lars A Olson
(74) *Attorney, Agent, or Firm* — Davis & Bujold, PLLC

(57) ABSTRACT

A control device, in particular for a boat drive, which comprises a control drive, a reduction gear system (8, 11, 15/17) and a control element (2) that can be pivoted through a steering angle. The reduction gear system comprises a multi-stage toothed gear transmission (8, 11, 15/17) with a toothed wheel (10) on the drive input side, and the control drive comprises two servomotors (6) which drive the toothed wheel (10) simultaneously but whose driving action are slightly opposed to one another.

12 Claims, 2 Drawing Sheets

CONTROL DEVICE AND BOAT DRIVE COMPRISING A CONTROL DEVICE

This application is a National Stage completion of PCT/EP2010/051698 filed Feb. 11, 2010, which claims priority from German patent application serial no. 10 2009 000 993.0 filed Feb. 18, 2009.

FIELD OF THE INVENTION

The invention concerns a control device and a boat.

BACKGROUND OF THE INVENTION

Known control devices, which comprise a servomotor or electric motor and, downstream therefrom, a toothed reduction gear system for moving a control element, often have the problem that there is play during the transmission of the control movement, particularly backlash play between the flanks of the gearwheels that mesh with one another. As a result, in its set position, i.e. when the servomotor is static, the control element is not stable. Such control devices are also used in boat drives that comprise a propulsion and steering unit which can pivot about a vertical axis, in particular an inboard drive. Control by means of such a control device has the particular disadvantage that as a result of the play the rudder or steering position concerned is unstable and the helmsman at the wheel has the sensation of indifferent and indirect steering.

From WO 2005/005249 an inboard propeller drive system is known, such that a propulsion unit comprises a propeller shaft with two tractor propellers rotating in opposite directions and an underwater casing arranged to pivot about a vertical axis in the hull. Thus, the steering action of the boat is obtained not—as conventionally—by a rudder, but by swiveling the propulsion vector that results from the propeller thrust. In this known propeller drive, the underwater casing with the propeller shaft is moved by a servomotor via a geared transmission. With this known control device as well, there is some play in the transmission of the steering movement, i.e. the helmsman's perception is that the rudder or steering mechanism operates inexactly and not directly.

SUMMARY OF THE INVENTION

The purpose of the present invention is to improve a control device of the type mentioned to begin with, to such effect that there is as little play as possible when the control device is operated. A further purpose of the invention, with a boat drive of the type mentioned at the start, is to provide a control device that works without play so that the helmsman at the wheel has the sensation of direct and stable steering.

According to the invention, with a control device having a multi-stage reduction gear system it is provided that the gearwheel on the drive input side is driven simultaneously by two servomotors which act slightly in opposition to one another. This gives the advantage that the play in the gear system, in particular the backlash play, is eliminated. The two servomotors operating in opposition allow no backlash of the gearwheel they are driving in common and, as it were, clamp it between them.

The objective of the invention is also achieved with a boat drive having the control device according to the invention with two servomotors driving in common, which act slightly in opposition to one another. The advantage of this play-free control for a boat drive is that it gives a stable "rudder position", i.e. a stable position of the propeller thrust vector.

Accordingly the boat keeps exactly on course and the helmsman at the wheel has the sensation that movements of the wheel are converted directly into a steering movement of the boat.

In a preferred embodiment the two servomotors are each in the form of electric motors, i.e. they draw their energy from the on-board electrical system, they can be regulated accurately, and they can be controlled electronically.

According to a further preferred embodiment the speed of the two servomotors or electric motors is in each case reduced by a first planetary gear system in a first stage, and in each case the drive output of the two planetary gear systems takes place via a drive pinion. This provides a first speed reduction mechanism in a relatively narrow structural space.

In a further preferred embodiment a second planetary gear system coaxial with the pivoting axis of the propulsion unit is provided. The second planetary gear system functions as a second reduction stage and is driven via its planetary carrier by the two drive pinions of the two first planetary gear systems.

According to another preferred embodiment a third toothed reduction stage is provided, in which the drive output side sun gear of the second planetary gear system meshes with outer teeth of a control sleeve which, for its part, is connected to the underwater casing. Overall, by virtue of the three compact reduction steps a high reduction ratio is obtained, so that a relatively small torque of the electric motors produces a very large steering torque for swiveling the propulsion vector produced by the propeller thrust. Furthermore—by virtue of electronic control means—a steering rate (angular speed) that is a function of the boat's speed and a steering angle that again depends on the boat's speed can also be obtained.

In a further preferred embodiment the propulsion and steering unit with the control device passes flexibly through a hull connecting piece fixed firmly to the hull of the boat. This allows the propulsion and steering unit to undergo vertical oscillation movements by virtue of an elastic mounting in the hull. Preferably, the connecting piece is in the form of a crash component with a sandwich structure. In the event of a collision this can absorb deformation energy.

BRIEF DESCRIPTION OF THE DRAWINGS

An example embodiment of the invention is illustrated in the drawing and described in more detail below, so that further features and/or advantages can emerge from the description and the drawings, which show.

DETAILED DESCRIPTION OF THE PREFERRED EMBODIMENTS

Figure 1:
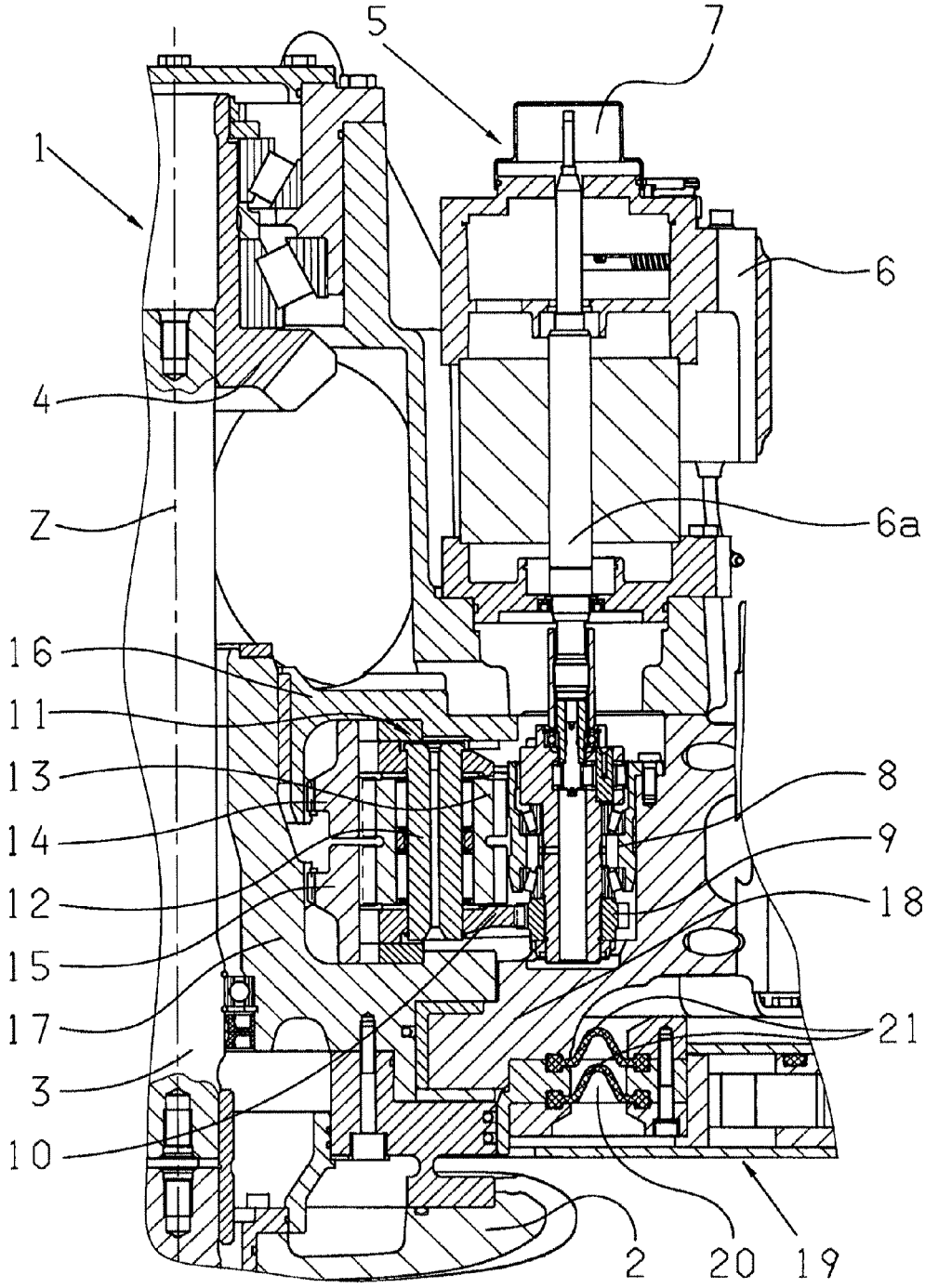
FIG. 1: A partial representation of a boat drive with a control device.

FIG. 1 shows a partial representation of a boat drive 1 with a propulsion and steering unit that can pivot about a vertical (upward) axis z, here represented in part by an underwater casing 2. The streamlined underwater casing 2 supports one propeller or two propellers (also called screws) that rotate in opposite directions (not shown), which are driven via a driveshaft 3 of an internal combustion engine (not shown) arranged in the hull of the boat. On the engine side the driveshaft 3 is driven by a bevel gear 4 (part of a bevel gear stage) and in turn it drives the propeller shaft or propeller shafts (not shown) by means of a bevel drive (not shown). The propeller shaft(s) can be swiveled by means of the pivoting underwater casing 2 so that the propulsion vector resulting from the propeller thrust forms an angle with the central axis of the vessel and therefore gives rise to a steering action. Thus, for this type of boat a conventional rudder is not needed. The underwater casing 2 is pivoted by a control device 5 comprising two servomotors in the form of electric motors, of which only one electric motor 6 with an electric brake 7 can be seen in the drawing. The electric motor 6 has a driveshaft 6*a*, which drives a coaxially arranged reduction gear system designed as a first planetary transmission 8. On the drive output side the first planetary transmission 8 has a drive pinion 9 which drives a planetary carrier 10 of a second planetary transmission 11, i.e. meshes with it. The driven planetary carrier 10 has planetary gears 13 mounted on planetary bolts 12, which are divided and in each case mesh with a fixed sun gear 14 and a drive output sun gear 15. The fixed sun gear 14 meshes with part of the housing 16 while the drive output sun gear 15 meshes with outer teeth of a control sleeve 17, which is mounted pivotably relative to a transmission housing 18 and is fixed in the axial direction. The control sleeve 17 is connected to the underwater casing 2 in a rotationally fixed manner. Overall, the reduction ratio from the motor driveshaft 6*a* via three reduction stages amounts to a total of around 1:1000.

The boat drive 1, in particular the transmission housing 18, passes through an opening of a hull connecting piece 19 and, with it, forms an annular gap 20 bridged by flexible sealing elements 21 and therefore sealed. The hull connecting piece 19 is made with a sandwich structure as a crash component connected firmly to the hull of the boat (not shown).

Figure 2:
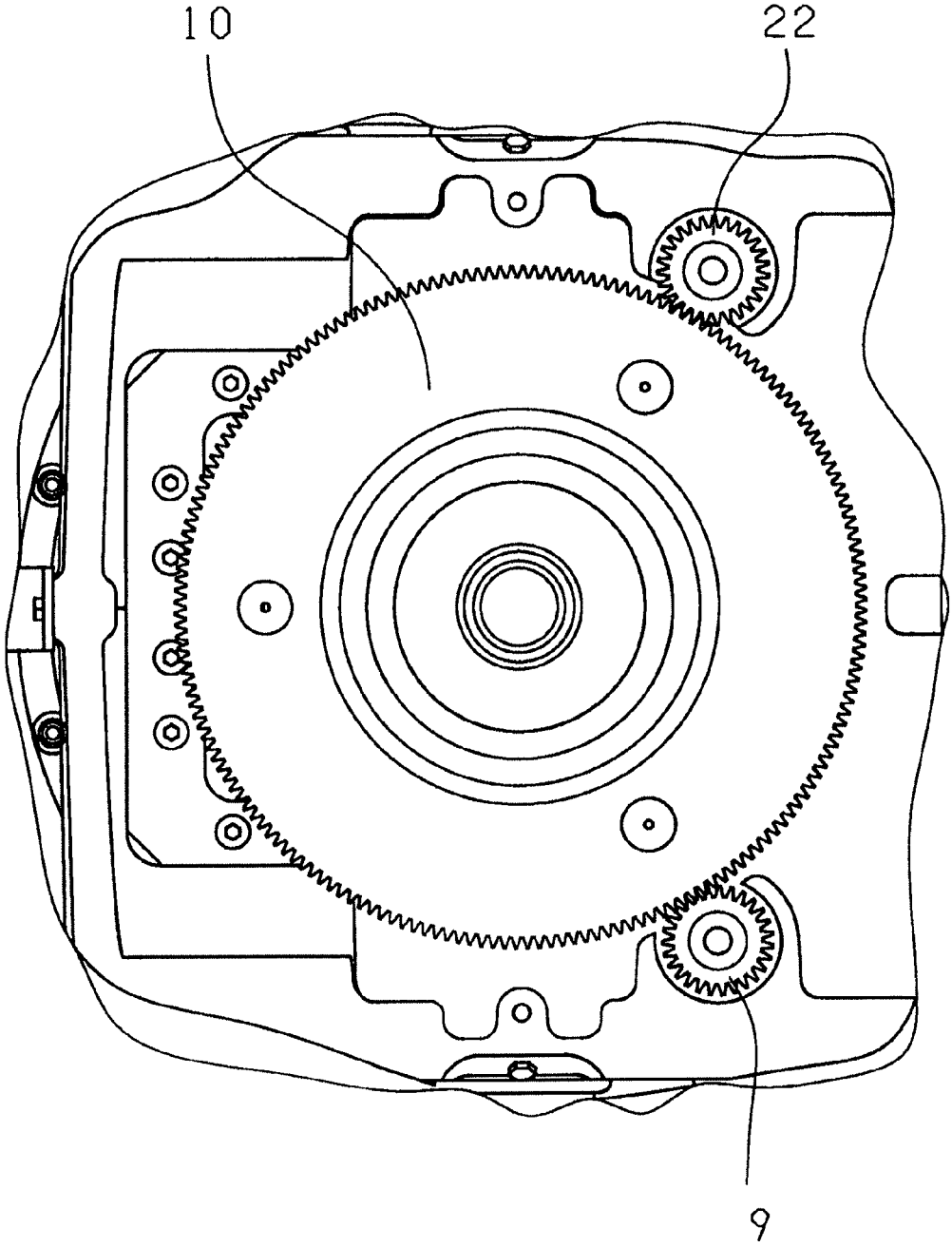
FIG. 2: A planetary carrier of the control device, driven by two drive pinions.

FIG. 2 shows a view in the axial direction, of the planetary carrier 10 in FIG. 1, which meshes with two drive pinions, the first drive pinion 9 (see FIG. 1) and a second drive pinion 22. Like the first drive pinion 9, so too the second drive pinion 22 is driven, i.e. by a second electric motor 6 with an electric brake 7, a driveshaft 6*a* and a second reduction gear system 8. Thus, the planetary carrier 10 is driven in common by the two drive pinions 9, 22, but in such manner that the two drive pinions 9, 22 act slightly in opposition to one another, so that any backlash play relative to the outer teeth of the planetary carrier 10 is eliminated. The planetary carrier 10 (also called planetary gear carrier) is thus "clamped" without play between the two drive pinions 9, 22. Consequently, any circumferential play when the underwater casing 2, i.e. the thrust vector, is swiveled is also practically eliminated. The control device 5 thus operates with no play, i.e. a stable "rudder position" is obtained at any given steering angle. At the same time, as soon as the helmsman at the wheel moves the wheel he senses a direct steering action. Accordingly the play at the steering wheel is also eliminated, i.e. the helmsman feels a direct reaction to his steering efforts (angular movements of the wheel).

INDEXES

1 Boat drive
2 Underwater casing (control element)
3 Driveshaft
4 Bevel gar
5 Control device
6 Electric motor (control drive)
6*a* Driveshaft
7 Electric brake
8 First planetary transmission ($1^{st}$ stage)
9 First drive pinion
10 Planetary carrier
11 Second planetary transmission ($2^{nd}$ stage)
12 Planetary bolts
13 Planetary gearwheel
14 Sun gear, fixed
15 Sun gear, drive output
16 Housing component
17 Control sleeve
18 Transmission housing
19 Hull connecting piece
20 Annular gap
21 Sealing element
22 Second drive pinion
z Vertical axis

The invention claimed is:

1. A control device comprising:
a control drive,
a reduction gear system (8, 11, 15/17), and
a control element (2) being pivotable about a steering angle,
the reduction gear system comprising a multi-stage toothed gear transmission (8, 11, 15/17) with a toothed wheel (10) on a drive input side, and
the control drive comprising first and second servomotors (6) which simultaneously drive the toothed wheel (10), and the first and the second servomotors (6) acting in opposition to one another.

2. A boat drive with a propulsion and steering unit (2), which is arranged in a hull of a boat such that the propulsion and steering unit (2) being pivotable about a vertical axis (z) and being moved by a control device (5) to produce a steering action for the boat through a steering angle, the control device comprising:
a reduction gear system (8, 11, 15/17) and the propulsion and steering unit (2) being pivotable through the steering angle,
the reduction gear system comprising a multi-stage toothed gear transmission (8, 11, 15/17) with a toothed wheel (10) on a drive input side and a control drive comprising first and second servomotors (6) which simultaneously drive the toothed wheel (10), and the first and the second servomotors (6) acting in opposition to one another.

3. The boat drive according to claim 2, wherein the first and the second servomotors each comprise an electric motor (6) with an electric brake (7).

4. The boat drive according to claim 3, wherein a first reduction stage is arranged downstream of each one of the electric motors (6), and the first reduction stage is a planetary transmission (8) with first and second drive pinions (9, 22).

5. The boat drive according to claim 4, wherein a second planetary transmission is arranged downstream of the first planetary transmission (8), and the second planetary transmission (11) is a second reduction stage.

6. The boat drive according to claim 3, wherein the toothed wheel on the drive input side is a planetary carrier (10) of the second planetary transmission (11) which simultaneously meshes with the two drive pinions (9, 22).

7. The boat drive according to claim 6, wherein the second planetary transmission (11) comprises, in addition to the planetary carrier (10), planetary gears (13) which mesh with a fixed sun gear (14) and a drive output sun gear (15).

8. The boat drive according to claim 7, wherein the drive output sun gear (15) meshes with outer teeth of a control sleeve (17) on the drive input side, to form a third reduction stage.

9. The boat drive according to claim 8, wherein the control sleeve (17) is connected to a pivotable underwater casing (2) which comprises at least a propeller and a driveshaft.

10. The boat drive according to claim 2, wherein with the control device (5), the propulsion and steering unit is flexibly inserted through a hull connecting piece (19) which is firmly joined with the hull of the boat.

11. The boat drive according to claim 10, wherein the hull connecting piece (19) is formed as a crash component with a sandwich structure.

12. A control device for a boat drive, the control device comprising:

a reduction gear system (8, 11, 15/17), and a casing (2) rotatably supporting a propeller driveshaft, the casing (2) being pivotable about a steering angle, the reduction gear system comprising a multi-stage toothed gear transmission (8, 11, 15/17) with a toothed wheel (10) which is located on a drive input side multi-stage toothed gear transmission (8, 11, 15/17) and first and second servomotors (6), each driving a drive pinion (9, 22) which engages the toothed wheel (10), the first and the second servomotors (6) simultaneously driving the toothed wheel (10) in opposition to one another.

* * * * *